US007954546B2

(12) United States Patent
Kim et al.

(10) Patent No.: US 7,954,546 B2
(45) Date of Patent: Jun. 7, 2011

(54) SUBTERRANEAN SCREEN WITH VARYING RESISTANCE TO FLOW

(75) Inventors: Namhyo Kim, Houston, TX (US); Yang Xu, Houston, TX (US); Michael H. Johnson, Katy, TX (US); Bennett M. Richard, Kingwood, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 6 days.

(21) Appl. No.: 12/399,748

(22) Filed: Mar. 6, 2009

(65) Prior Publication Data

US 2010/0224359 A1 Sep. 9, 2010

(51) Int. Cl.
*E21B 43/00* (2006.01)

(52) U.S. Cl. ..... 166/231; 166/227; 166/235; 166/234; 166/233; 166/236

(58) Field of Classification Search ..... 166/227, 166/231, 233–236
See application file for complete search history.

(56) References Cited

U.S. PATENT DOCUMENTS

| | | | | |
|---|---|---|---|---|
| 4,167,972 | A | 9/1979 | Seart | |
| 5,165,476 | A | 11/1992 | Jones | |
| 6,622,794 | B2 * | 9/2003 | Zisk, Jr. | 166/373 |
| 7,290,606 | B2 | 11/2007 | Coronado et al. | |
| 7,409,999 | B2 | 8/2008 | Henriksen et al. | |
| 7,467,665 | B2 | 12/2008 | Mackenzie | |
| 7,690,097 | B1 * | 4/2010 | Cooper et al. | 29/447 |
| 2003/0066651 | A1 | 4/2003 | Johnson | |
| 2007/0246212 | A1 * | 10/2007 | Richards | 166/227 |
| 2008/0035350 | A1 | 2/2008 | Henriksen et al. | |

OTHER PUBLICATIONS

Augustine, Jody R., "An Investigation of the Economic Benefit of Inflow Control Devices on Horizontal Well Completions Using a Reservoir-Wellbore Coupled Model", SPE 78293; Oct. 2002, 1-10.
Rodrigues, Valdo Ferreira, et al., "Equalization of the Water Injection Profile of a Subsea Horizontal Well: A Case History", SPE 112283, Feb. 2008, 1-6.
Augustine, J., et al., "World's First Gravel-Packed Uniform Inflow Control Completion", SPE 103195, Sep. 2006, 1-10.
Lorenz, Michael, et al., "Uniform InFlow Completion System Extends Economic Field Life: A Field Case Study and Technology Overview", SPE 101895, Sep. 2006, 1-9.
Ratterman, E.E., "New Technology To Increase Oil Recovery by Creating Uniform Flow Profiles in Horizontal Wells: Case Studies and Technology Overview", IPTC 10177, Nov. 2005, 1-9.
Garcia, Gonzalo A., et al., "Identifying Well Completion Applications for Passive Inflow Control Devices", SPE 124349, Oct. 2009, 1-19.

* cited by examiner

*Primary Examiner* — Daniel P Stephenson
*Assistant Examiner* — Yong-Suk Ro
(74) *Attorney, Agent, or Firm* — Steve Rosenblatt

(57) ABSTRACT

A screen section is made with variable resistance to flow in the screen material to balance the flow along the screen length. In one variation different discrete zones have screens configured for different percentages of open area while all have the same particle filtration capability. In another variation discrete portions have differing amounts of overlapping screen portions so as to balance flow without affecting the particle size screened. The cross-sectional shape of a wire wrap underlayment for the screen is made closer to trapezoidal to decrease the angle of opening for the incoming flow paths toward the base pipe. In this manner flow resistance is reduced and flow is increased due to reduced turbulence.

15 Claims, 3 Drawing Sheets

SUBTERRANEAN SCREEN WITH VARYING RESISTANCE TO FLOW

FIELD OF THE INVENTION

The field of this invention is downhole screens that can be used in production or injection service where there is a need to balance the flow in a given zone among a series of screen sections and within given screen sections themselves.

BACKGROUND OF THE INVENTION

Many long producing formations such as for example in open hole use a series of screen sections. In a long horizontal run the screen nearest the heel or the surface will be a path of least resistance as compared to other screen sections further into the horizontal run. The same is true for deviated and even vertical subterranean formations. To compensate for this short circuiting in the horizontal run screen sections have been assembled into a string where the base pipes are not perforated but provide a series of flow channels to a static flow control device such as a spiral restricted path. The spirals in different sections offer different resistance so as to balance the flow through the various screen sections regardless of whether the flow is in from the formation or out in injection service. The assembly is illustrated in U.S. Pat. No. 6,622,794. Related references to this concept are U.S. Pat. Nos. 7,467,665; 7,409,999 and 7,290,606.

While balancing flow among discrete spaced apart screen sections is accomplished with the spiral paths that offer to balance the flow through the assortment of screen assemblies, the flow patterns in each screen section are virtually unaffected in a given screen section that can be about 10 meters long. The present invention attempts to address this issue at a given screen section by providing a screen structure that compensates for what would otherwise be flows driven by the paths of least resistance and that would leave more of the flow moving at a high velocity through the screen at the location of an inflow control device closest to the surface. The higher velocities at the shorter paths to the surface even with inflow control devices have caused damage to screens from erosion and have caused undesirable production of water or particulates. The present invention provides varying resistance to flow in a given screen section in several ways. By way of example, the number of openings of a given size in a given subsection can vary along the length of a screen. Alternatively identical screens can be overlapped in discrete portions of a screen length. Alternatively, the density of openings of a given size can vary along the length of a given screen section to balance flow through it. The wire wrap cross-section that underlies a screen can be reconfigured from the known triangular cross-section to a different shape that is more toward trapezoidal so that less turbulence is created on entry toward the base pipe to reduce the overall flow resistance in a given section of screen. Those skilled in the art will better appreciate the invention from a review of the description of the preferred embodiment and the associated drawings while realizing that the full scope of the invention is given by the appended claims.

SUMMARY OF THE INVENTION

A screen section is made with variable resistance to flow in the screen material to balance the flow along the screen length. In one variation different discrete zones have screens configured for different percentages of open area while all have the same particle filtration capability. In another variation discrete portions have differing amounts of overlapping screen portions so as to balance flow without affecting the particle size screened. The cross-sectional shape of a wire wrap underlayment for the screen is made closer to trapezoidal to decrease the angle of opening for the incoming flow paths toward the base pipe. In this manner flow resistance is reduced and flow is increased due to reduced turbulence. In addition, the trapezoidal screen cross section geometry is advantageous in obtaining uniform inflow profile along the screen length.

BRIEF DESCRIPTION OF THE DRAWINGS

FIG. 3 is a section view through a prior art wire wrap material that supports a screen assembly around a base pipe to create a flow annulus in between;

DETAILED DESCRIPTION OF THE PREFERRED EMBODIMENT

Figure 5:
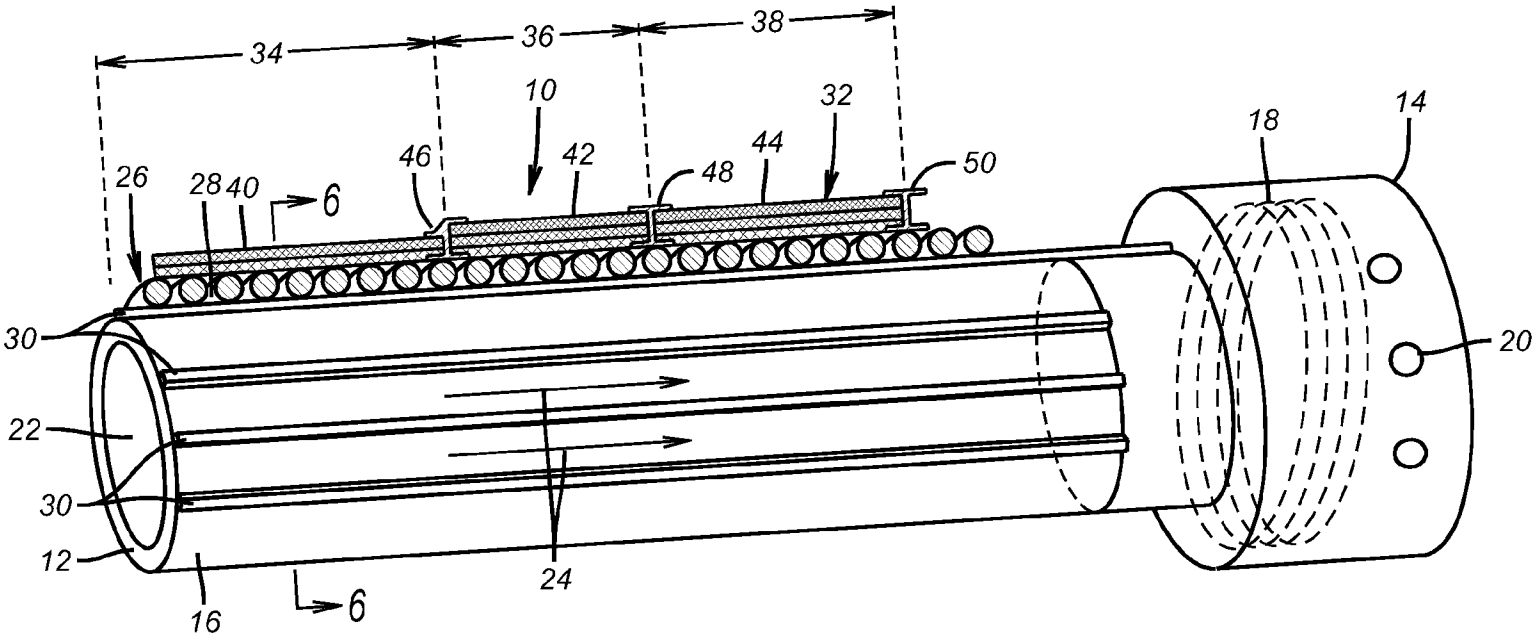
FIG. 5 is a part section part perspective view of a screen assembly as shown in FIG. 1.
Figure 6:
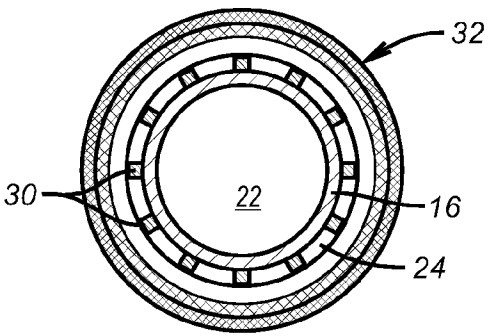
FIG. 6 is a view along line 6-6 of FIG. 5.

Starting first with FIGS. 5 and 6 there is illustrated a screen section 10 that is assembled into a string (not shown) for running into a subterranean formation (not shown). Typically screens come in sections of various lengths but usually about 10 meters long. Apart from end connections that are not shown between ends 12 and 14 there is a solid base pipe 16 that is closed at end 12 and which extends into a spiral path 18 before passing through one or more openings 20 to flow into passage 22 and to the surface when in production mode. When in injection mode the flow direction for the injection hot fluid, generally steam, is reversed.

Figure 1:
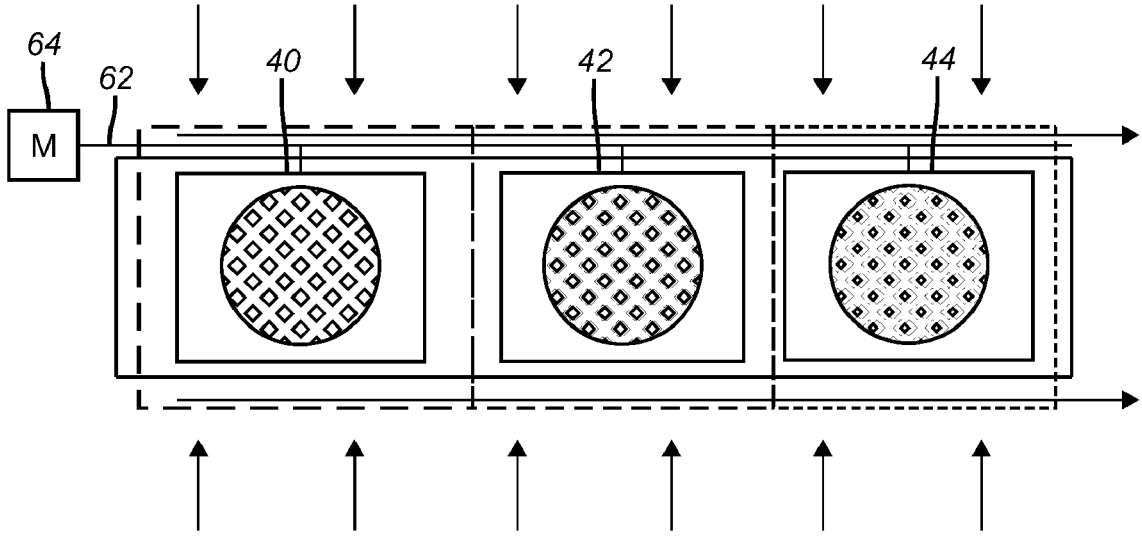
FIG. 1 is a schematic of a first embodiment of a screen assembly showing screen segments with different open areas at discrete axial segments.

An annular flow space represented by arrow 24 is defined by a wire wrapped into a cylindrical shape 26 with a spiral wound gap 28 held at a relatively constant dimension by a plurality of ribs 30 welded or otherwise joined to the cylindrical shape 26. Overlayed on the cylindrical shape 26 is the screen assembly 32. In the illustrated embodiment, there are illustrated three discrete zones 34, 36 and 38 for illustrative purposes. Those skilled in the art will appreciate that fewer or greater numbers of zones can be used and that the zones need to overlay the entire cylindrical shape 26 to avoid short circuiting of fluid around the screen assembly 32. Screen 40 is in zone 34 which is the furthest from the surface. It accordingly offers less resistance to a given flow rate than screen 42 in zone 36 which in turn offers less resistance to the same flow rate through screen 44 in zone 38. Stated differently, because the path of least resistance is through screen 44 because it is closest to the surface where an inflow control device could be located, the open area percent of screen 44 is the lowest of the three screens shown while screen 40 has the highest open area to flow of the three sections. One way to do this is to vary the number of openings in each screen. Another is to make the screen areas different and yet another way is to use both variables together. The objective in a given screen section 10 for a given flow rate is to distribute that total flow rate evenly across however many zones are employed. FIG. 1 also shows this principle another way by schematically using dashed lines of different dot densities to indicate more flow resistance at screen 44 progressively decreasing in resistance until screen 40. The objective is to still exclude down to the same particle size range at each screen section 40, 42 and 44 while offering varying resistance to compensate for the different flow path lengths associated with each of these screens.

It should be noted that different screen styles can be used including a mesh or a weave as long as the segments in the various zones are screening down to a comparable particle size. It should further be noted that the spiral path 18 in a plurality of different sections 10 that make up a string in a zone of interest are used to balance flow among the screen sections 10 in gross. The screen assembly variations 32 are designed to balance incoming or exiting flow through a given screen assembly 32 on a given section 10. Note that dividers 46, 48 and 50 can be used to separate adjacent zones.

Figure 2:
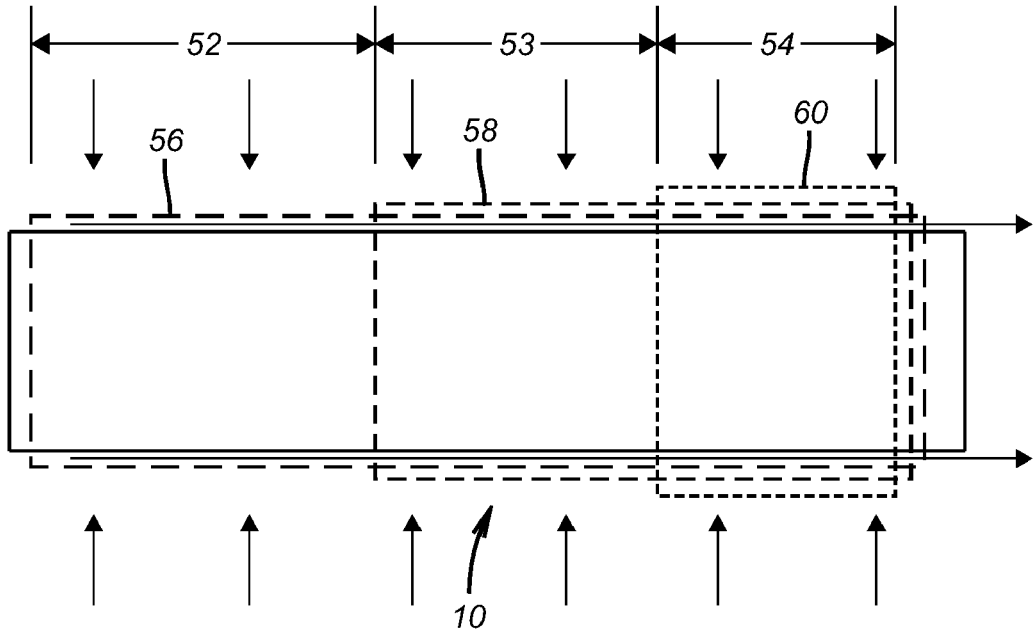
FIG. 2 is a second embodiment showing overlapping in discrete zones and to different degrees to achieve a flow balance through the screen assembly.

FIG. 2 illustrates another way to accomplish the objective of flow balancing in a given screen section 10. Here, for illustrative purposes of the overlapping technique there are three zones shown 52, 53 and 54. In zone 52 there is a single layer of screen 56 that extends for three zones. In zone 53 screen 58 starts and runs into zone 54. In zone 54 screen 60 starts and runs in that zone only. The overlapping that differs in the various zones allows filtration down to a desired particle size while balancing the flow through a given screen section 10 illustrated in FIG. 2.

Yet another variation for flow balancing within a screen section 10 is to dynamically balance the given zones such as for example having an operable perforated drum under each screen that is concentric with a fixed perforated drum under all screen sections. If there are three zones, for example, there can be three independently operated drums shown schematically as line 62 that can align or misalign openings using one or more motors 64 that are locally or surface controlled with respect to the fixed drum to compensate for operating conditions that are detected by flow sensors so as to be able to alter the flow resistance among the zones to compensate for conditions as they occur such as partial plugging of a given zone or other conditions that change the resistance to flow among the screens on a section 10.

Figure 3:
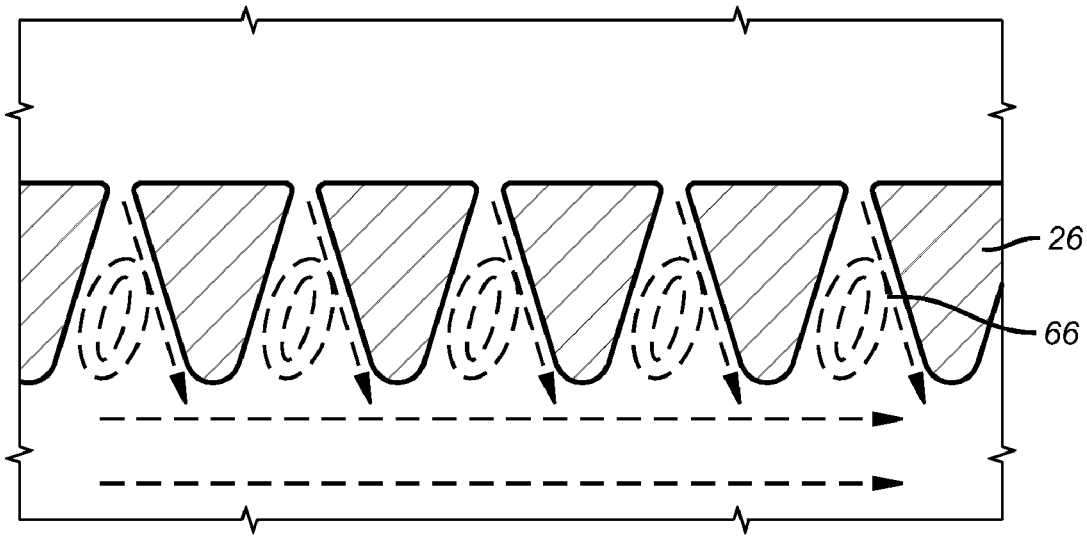
Figure 4:
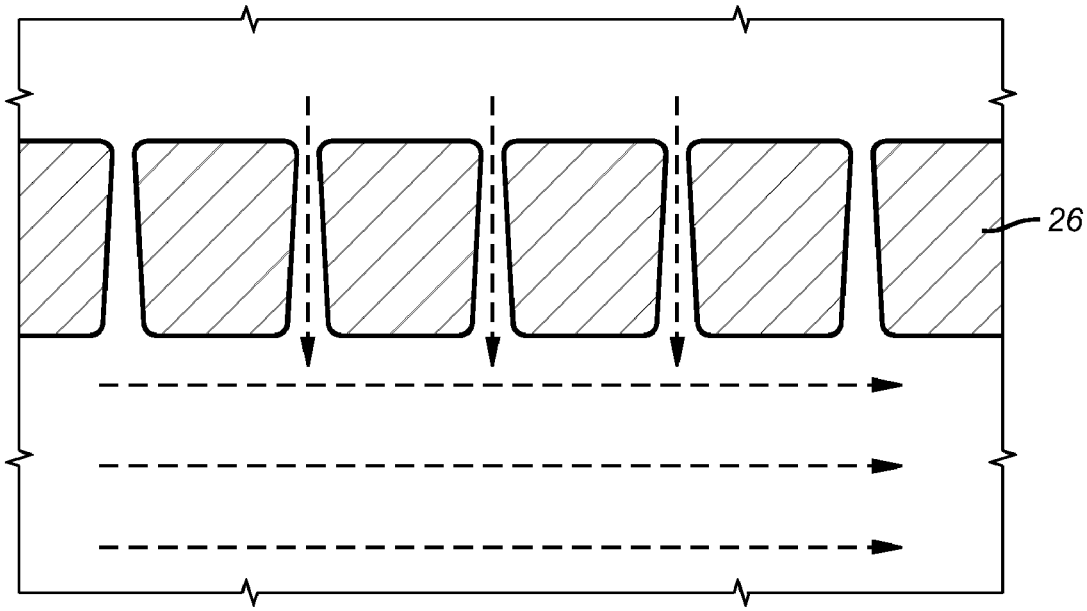
FIG. 4 is a section through a wire wrap of the present invention that reduces turbulence of flow through it.

FIG. 3 is a section through the wire wrap cylinder such as 26 in FIG. 5 using the prior art wire that has a triangular cross-section so as to create a V-shaped opening for production inflow defining an angle in the range of 25-35 degrees. This shape has been demonstrated to cause turbulence as illustrated by a swirling arrow 66 which winds up increasing pressure drop and decreasing production flow. FIG. 4 shows that a shape change of the wire cross-section reducing the taper angle to a range of 0 to 10 degrees with a preferred range of 5-10 degrees creates less flow turbulence and increases throughput of a particular section of screen 10.

The above description is illustrative of the preferred embodiment and many modifications may be made by those skilled in the art without departing from the invention whose scope is to be determined from the literal and equivalent scope of the claims below.

We claim:

1. A screen section for downhole use as a part of a tubular string extending into a subterranean location from the surface, comprising:

a base pipe with end connections to attach to a tubing string and at least one opening through the base pipe wall for flow communication to a passage therethrough;

a screen assembly mounted over said base pipe between said connections defining a plurality of screen zones having differing resistance to the same flow rate through them;

the flow resistance in at least one screen of said screen zones can be changed after said screen assembly is assembled to a string without changing the flow resistance in other screen zones.

2. The screen section of claim 1, wherein:

said zones are discrete.

3. The screen section of claim 1, wherein:

said zones comprise screens having differing open areas.

4. The screen section of claim 1, wherein:

said zones comprise differing numbers of layers of screen.

5. The screen section of claim 4, wherein:

said layers are made from identical screens.

6. The screen section of claim 1, wherein:

said zones have equal exterior surface areas.

7. The screen section of claim 1, wherein:

said zones have unequal exterior surface areas.

8. The screen section of claim 1, further comprising:

a cylindrical shape made of a wrapped wire defining a spiral slotted opening, said cylinder disposed coaxially and between said base pipe and said screen assembly, said opening defining a taper between 0 and 10 degrees.

9. The screen section of claim 8, wherein:

said taper widens in the direction of flow.

10. The screen section of claim 8, wherein:

said base pipe is not perforated under said screen assembly to define a flow passage under said wire wrapped cylindrical shape to said at least one opening in said base pipe.

11. The screen section of claim 10, further comprising:

a spiral flow path between said flow passage and said opening in said base pipe.

12. The screen section of claim 8, wherein:

the cross-section of said wire is trapezoidal.

13. The screen section of claim 1, wherein:

the flow resistance of at least one zone can be changed from the surface.

14. The screen section of claim 13, wherein:

said flow resistance is changed by relative rotation of perforated tubular members.

15. The screen section of claim 1, wherein:

said screen assembly comprises screens that are designed to filter out solids down to the same particle size.

* * * * *